US008006924B2

(12) United States Patent
Johansson

(10) Patent No.: US 8,006,924 B2
(45) Date of Patent: Aug. 30, 2011

(54) REFINER PLATE ASSEMBLY AND METHOD WITH EVACUATION OF REFINING ZONE

(75) Inventor: Ola M. Johansson, Brookfield, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 0 days.

(21) Appl. No.: 12/488,268

(22) Filed: Jun. 19, 2009

(65) Prior Publication Data

US 2009/0302140 A1 Dec. 10, 2009

Related U.S. Application Data

(60) Continuation-in-part of application No. 12/041,379, filed on Mar. 3, 2008, which is a division of application No. 11/068,490, filed on Feb. 28, 2005, now Pat. No. 7,347,392.

(60) Provisional application No. 61/074,622, filed on Jun. 21, 2008.

(51) Int. Cl.
*B02C 7/12* (2006.01)

(52) U.S. Cl. ..... 241/21; 241/28; 241/298

(58) Field of Classification Search ..... 241/261.2, 241/261.3, 296–298, 30, 21, 28
See application file for complete search history.

(56) References Cited

U.S. PATENT DOCUMENTS

| | | | | |
|---|---|---|---|---|
| 4,039,154 | A | 8/1977 | Peterson | |
| 4,083,503 | A | 4/1978 | Langdon | |
| 4,129,263 | A | 12/1978 | Sjobom | |
| 4,221,631 | A | 9/1980 | Hellerqvist et al. | |
| 4,401,280 | A * | 8/1983 | Reinhall | 241/247 |
| 4,676,440 | A * | 6/1987 | Perkola | 241/261.3 |
| 4,783,014 | A | 11/1988 | Fredriksson et al. | |
| 5,165,592 | A | 11/1992 | Wasikowski | |

(Continued)

FOREIGN PATENT DOCUMENTS

EP 0877117 A2 11/1998

(Continued)

OTHER PUBLICATIONS

Office Action Summary and Detailed Action, U.S. Appl. No. 11/068,490 / Patent No. 7,347,392, Dec. 5, 2006.

(Continued)

*Primary Examiner* — Mark Rosenbaum
(74) *Attorney, Agent, or Firm* — Quarles & Brady LLP

(57) ABSTRACT

A refiner plate assembly and method includes an annular arrangement of adapter subplates that mount to a refiner disk of a disk refiner using a conventional mounting technique, such as bolted in a standard pattern associated with the particular disk refiner. The adapter subplate arrangement remains mounted to the disk and provides a universal mounting surface for an annular arrangement of individual removable refiner segments. A steam and/or accept evacuation channel is provided in this assembly via filter passages at a radially intermediate location in one or more refiner segments which communicate with a recess or channel in one or more associated adapter subplates that direct the steam and/or accepts through outlet ports in the outer rim of the adapter subplate(s). Refining efficiency is provided in a universal refiner plate assembly by eliminating steam volume and already refined pulp from outer portions of the refining zone. The filter section(s) can be placed at an optimal location of high volume fraction of pulp fibers where mounting hardware is typically located in conventional refiner segments.

20 Claims, 14 Drawing Sheets

U.S. PATENT DOCUMENTS

| | | | | |
|---|---|---|---|---|
| 5,248,099 | A | 9/1993 | Lahner et al. | |
| 5,335,865 | A | 8/1994 | Kohler et al. | |
| 5,373,995 | A | 12/1994 | Johannson | |
| 5,425,508 | A | 6/1995 | Chaney | |
| 5,492,548 | A | 2/1996 | Wasikowski | |
| 5,695,136 | A | 12/1997 | Rohden et al. | |
| 5,823,453 | A | 10/1998 | Garasimowicz | |
| 5,824,265 | A | 10/1998 | Dodd | |
| 5,863,000 | A * | 1/1999 | Gingras | 241/28 |
| 5,868,330 | A | 2/1999 | Dodd et al. | |
| 5,875,982 | A | 3/1999 | Underberg | |
| 5,934,585 | A | 8/1999 | Chaney | |
| 5,988,538 | A | 11/1999 | Bartels | |
| 7,347,392 | B2 | 3/2008 | Johansson | |
| 2009/0302140 | A1 | 12/2009 | Johansson | |

FOREIGN PATENT DOCUMENTS

| | | | |
|---|---|---|---|
| GB | 2 083 375 | A | 3/1982 |
| SE | 530931 | C2 | 8/2006 |
| WO | WO9600616 | A1 | 1/1996 |
| WO | WO0006302 | A1 | 2/2000 |

OTHER PUBLICATIONS

Response to Dec. 5, 2006, Office Action, U.S. Appl. No. 11/068,490 / Patent No. 7,347,392, Apr. 5, 2007.

Office Action Summary and Detailed Action, U.S. Appl. No. 11/068,490 / Patent No. 7,347,392, May 8, 2007.

Response to May 8, 2007, Office Action, U.S. Appl. No. 11/068,490 / Patent No. 7,347,392, Sep. 10, 2007.

Extended European Search Report, PCT/US2006006001881, EP06718887, Sep. 22, 2008.

Supplementary European Search Report, PCT/US2006001881, EP06718887, Oct. 9, 2008.

European Patent Office Communication, EP06718887, Feb. 25, 2009.

Response to Feb. 25, 2009, Office Communication, EP06718887, Sep. 7, 2009.

Intellectual Property Office of New Zealand Examination Report, Patent Application No. 560984, Jul. 9, 2009.

IP Australia Examiner's First Report, Patent Application No. 2006219030, Apr. 21, 2010.

Response to Apr. 21, 2010, IP Australia Examiner's First Report, Patent Application No. 2006219030, Aug. 19, 2010.

PCT International Search Report and Written Opinion, PCT/US2006/001881, Mar. 7, 2007.

PCT International Preliminary Report on Patentability, PCT/US2006/001881, Sep. 20, 2007.

Swedish Patent Office Communication, Patent Application No. 0600397-4, Jan. 19, 2007.

Swedish Patent Office Final Office Action, Patent Application No. 0600397-4, Jun. 11, 2008.

Office Action Summary and Detailed Action, U.S. Appl. No. 12/041,379, May 7, 2010.

Response to May 7, 2010, Office Action and First Amendment, U.S. Appl. No. 12/041,379, Aug. 3, 2010.

Office Action Summary and Detailed Action, U.S. Appl. No. 12/041,379, Aug. 11, 2010.

PCT International Search Report and Written Opinion, PCT/US2009/048002, Aug. 9, 2010.

Response to Intellectual Property Office of New Zealand Examination Report of Jul. 9, 2009, Patent Application No. 560984, Nov. 2, 2010.

Response to Aug. 11, 2010, Office Action, U.S. Appl. No. 12/041,379, Nov. 5, 2010.

Request for Continued Examination, U.S. Appl. No. 12/041,379, Nov. 5, 2010.

* cited by examiner

REFINER PLATE ASSEMBLY AND METHOD WITH EVACUATION OF REFINING ZONE

CROSS-REFERENCE TO RELATED APPLICATIONS

This application claims benefit to U.S. provisional application Ser. No. 61/074,622, filed Jun. 21, 2008, and is a continuation-in-part of U.S. application Ser. No. 12/041,379, filed Mar. 3, 2008, which is a divisional of U.S. application Ser. No. 11/068,490, filed Feb. 28, 2005 now U.S. Pat. No. 7,347,392, issued Mar. 25, 2008.

STATEMENT OF FEDERALLY SPONSORED RESEARCH OR DEVELOPMENT

Not applicable.

BACKGROUND OF THE INVENTION

1. Technical Field

The present invention relates to disk refiners and more particularly to improvements in refiner plates and mounting assemblies therefore.

2. Description of the Related Art

Disk refiners are used in the paper manufacturing industry to prepare the cellulose fibers of a paper pulp into a desired condition prior to delivering the pulp to the papermaking machine. Double disk refiners, such as described in U.S. Pat. No. 4,083,503, have refiner plates attached to a rotating disk, or rotor, and complementary refiner plates attached to an opposing, non-rotating disk, or stator. Multiple disk refiners, such as described in U.S. Pat. No. 4,783,014, have a plurality of rotatable and non-rotatable refiner plates interleaved within a refining chamber of the refiner. Counter-rotating disk refiners, such as described in U.S. Pat. No. 4,129,263, have two counter-rotating refining disks each mounted to its own motor-driven shaft.

There are many different disk refiners of differing configurations and diameters. There are also many different types of refiner plates. One type of a refiner plate is a complete annular plate which is cast or otherwise manufactured as a one-piece member. A major disadvantage of complete annular refining plates is the high cost of fabrication, and difficulties associated with the transport and installation of such a large, heavy component. These issues are avoided by a refiner plate which comprises a plurality of individual segments which cooperatively form an annular plate when fitted together. U.S. Pat. Nos. 4,039,154 and 5,425,508 provide examples refiner plates having a plurality of individual segments, which are assembled to form a complete annular plate.

Moreover, refiner plates have a working refining surface that is typically formed by a plurality of spaced apart, raised, rib-like projections, generally called "bars". There are many refiner plate patterns which are well-known within the paper industry. The bars and other portions of the working surface are gradually abraded or worn away from use, and are subject to damage from excessive loading, such that they require replacement periodically. Thus, another advantage in using segmented refiner plates pertains to replacement of worn or damaged bars. Replacing an entire annular refiner plate due to wear or damage in a discrete part of the refiner plate is inefficient and costly compared to replacing only the segment or segments that are worn or damaged.

Furthermore, regardless of the refiner plate type or bar pattern, the mounting arrangement can vary by refiner manufacturer, and even a single refiner manufacturer may utilize different plate mounting arrangements in terms of the number, size and spacing of the mounting bolts, especially when the overall size of the plates vary considerably. Consequently, a refiner plate manufacturer supplying refiner plates for several manufacturer's refiners have been required to manufacture numerous different refiner plates of the same diameter to be used in the many different disk refiners, even if the same bar configuration is used.

This latter situation can be improved by using an adapter to mount the refiner segments. U.S. Pat. No. 5,934,585, assigned to the assignee of the present invention, and hereby incorporated be reference herein, provides an example of mounting assembly in which an adapter has holes that match the standard bolt pattern of the refiner disk. Refiner segments then mount to the adapter using a clamping ring. Since only the adapter bolts to the refiner disk, and since the adapters are not wear parts, for any given bar pattern refiner manufacturers can supply a single replacement refiner segment type for different disk refiners.

Additionally, while the refiner plate bars can be sized and aligned in many different ways, they generally narrow in the radial outward direction to facilitate courser to finer refining of the pulp and are also aligned in some way that facilitates flow of the pulp between the bars toward the outer periphery of the refiner plate. One additional issue with existing refiner plates, is that it is inefficient to refine pulp, for example at finer bars located in a radially outer region of the refiner segment, that has already been sufficiently refined to an acceptable size. U.S. Pat. No. 7,347,392, which is also assigned to the assignee of the present invention, and hereby incorporated as though fully set forth herein, provides an example of refiner plates that have internal flow channels through which steam and "accepts" can be carried away from the refining surface between the refiner plates so that they are not refined further. While this provides a significant improvement in efficiency when compared to conventional large refiner segments, it complicates the manufacturing process. Sand casting, a less accurate and more costly technique, is used to create sand core in the casting mold that forms the internal flow channels in the segment. This can lead to imperfections or defects in the cast refiner segment as a result of the release gas into the molten steel as the sand is burned off during the casting process.

SUMMARY OF THE INVENTION

A refiner plate assembly and method provides for improved refining by evacuating steam and acceptably refined pulp fiber at an early, intermediate stage of the refining zone so that an increased concentration and volume of unrefined fibers can be passed to later stages of the refining zone. This is accomplished in a refiner plate assembly in which adapter subplates, designed for use with a particular disk refiner, mount universal refiner segments that can be readily replaced when worn or damaged without removing the adapter subplates.

Steam and/or accepts are evacuated via filter passages at a radially intermediate location in one or more refiner segments which communicate with a recess or channel in one or more associated adapter subplates that direct the steam and accepts through outlet ports in the outer rim of the adapter subplate(s). Thus, refining efficiency is provided in a universal refiner plate assembly by eliminating steam volume and already refined pulp from outer portions of the refining zone. The filter section(s) can be placed at an optimal location of high volume fraction of pulp fibers where mounting hardware is typically located in conventional refiner segments.

Specifically, in one aspect the invention provides a refiner plate assembly for refining pulp in a disk refiner having a refiner plate mounting surface. The refiner plate assembly includes an adapter subplate and a refiner segment. The adapter subplate defines a segment mounting surface and an evacuation channel leading from an intermediate location of the refiner plate assembly to an outer periphery of the adapter subplate. The refiner segment has a filter section defined by a plurality of passages extending between its refining surface and its undersurface. The passages are sized to permit steam and accept pulp fibers at the intermediate location of the refiner plate assembly to pass from the refining surface to the evacuation channel of the adapter subplate. The adapter subplate is mountable to the refiner plate mounting surface of the disk refiner and the refiner segment is releasably mountable to the segment mounting surface of the adapter subplate such that the refining surface of the refiner segment is at a refining zone of the disk refiner.

In another aspect the invention provides a refiner plate assembly including: at least two substantially flat annular refiner plate mounting surfaces defined by opposing disks of a disk refiner defining a refining zone therebetween; a plurality of adapter subplates mounted to each refiner plate mounting surface end to end in an annular arrangement; and a plurality of refiner segments, with refining bars, mounted to each segment mounting surface end to end in an annular arrangement. At least one of the annular adapter plate arrangements has a segment mounting surface defining a part of an evacuation channel extending from an intermediate location radially between inner and outer peripheries of the adapter subplate arrangement to an opening in its outer rim. At least one annular refiner disk arrangement is associated with adapter subplate arrangement having an evacuation channel and includes a filter section with a plurality of passages extending between the refining surface and an undersurface thereof. The plurality of passages are sized to permit steam and accept pulp fibers at the intermediate location to pass from the refining surface to the evacuation channel of the adapter subplate arrangement.

In yet another aspect the invention provides a method of refining pulp in a disk refiner of the type previously described. The method includes: (a) passing pulp into a refining zone between the two refiner disks; (b) establishing relative rotation of the refiner disks; (c) passing pulp along a refining surface of the annular refiner segment arrangement from an inner periphery; (d) passing steam and accept pulp fiber through at least one filter section at an intermediate location of the annular refiner segment arrangement, the filter section including a plurality of passages extending between the refining surface and an undersurface and are sized to permit the accept pulp fiber at the intermediate location to pass through the annular refiner segment arrangement; and (e) passing the accept pulp fiber from the filter passages to an evacuation channel formed in the annular adapter subplate arrangement.

The objects, features, and advantages of the invention will become readily apparent to those skilled in the art upon reading the description of the disclosure in conjunction with the attached drawings.

DETAILED DESCRIPTION OF THE DISCLOSURE

Figure 1:
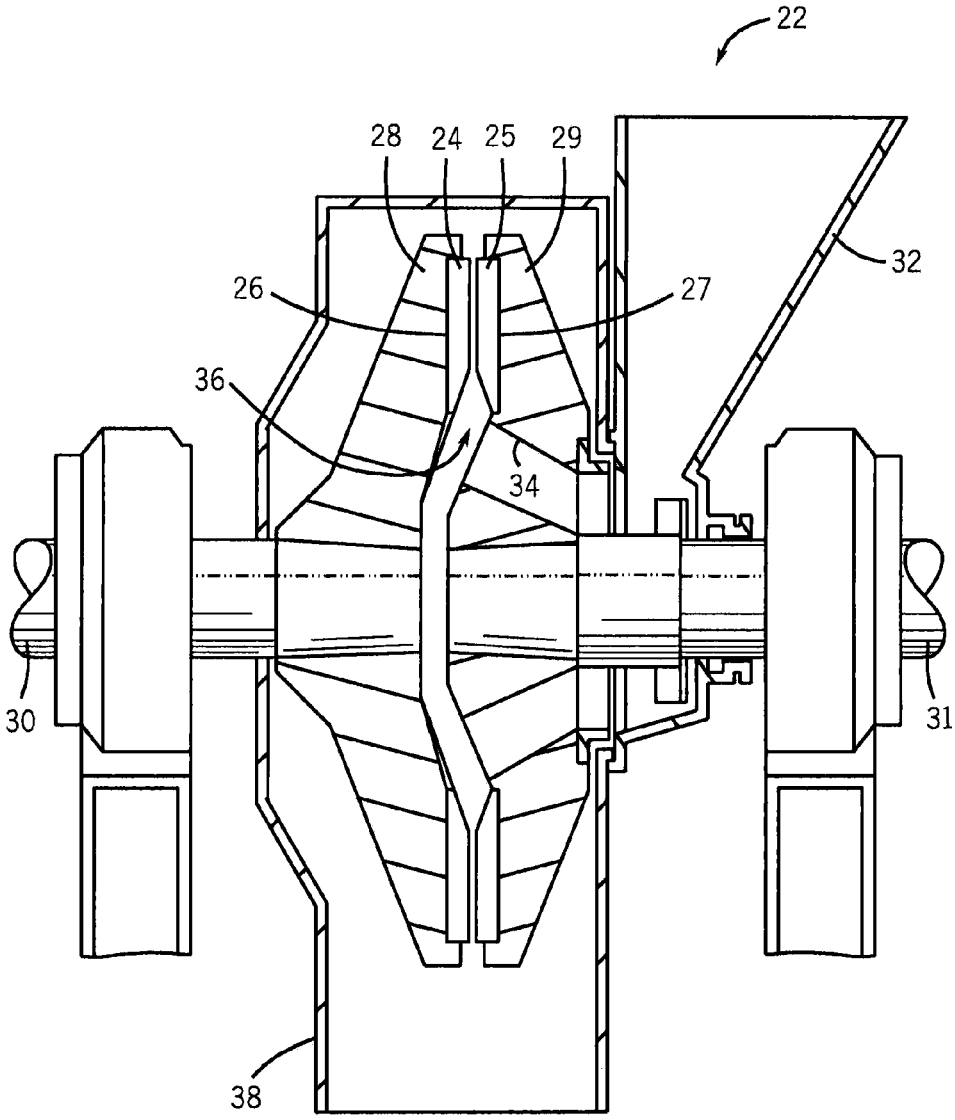
FIG. 1 is an elevational view of an exemplary disk refiner, of the counter-rotating type, shown in partial cross-section.
Figure 4:
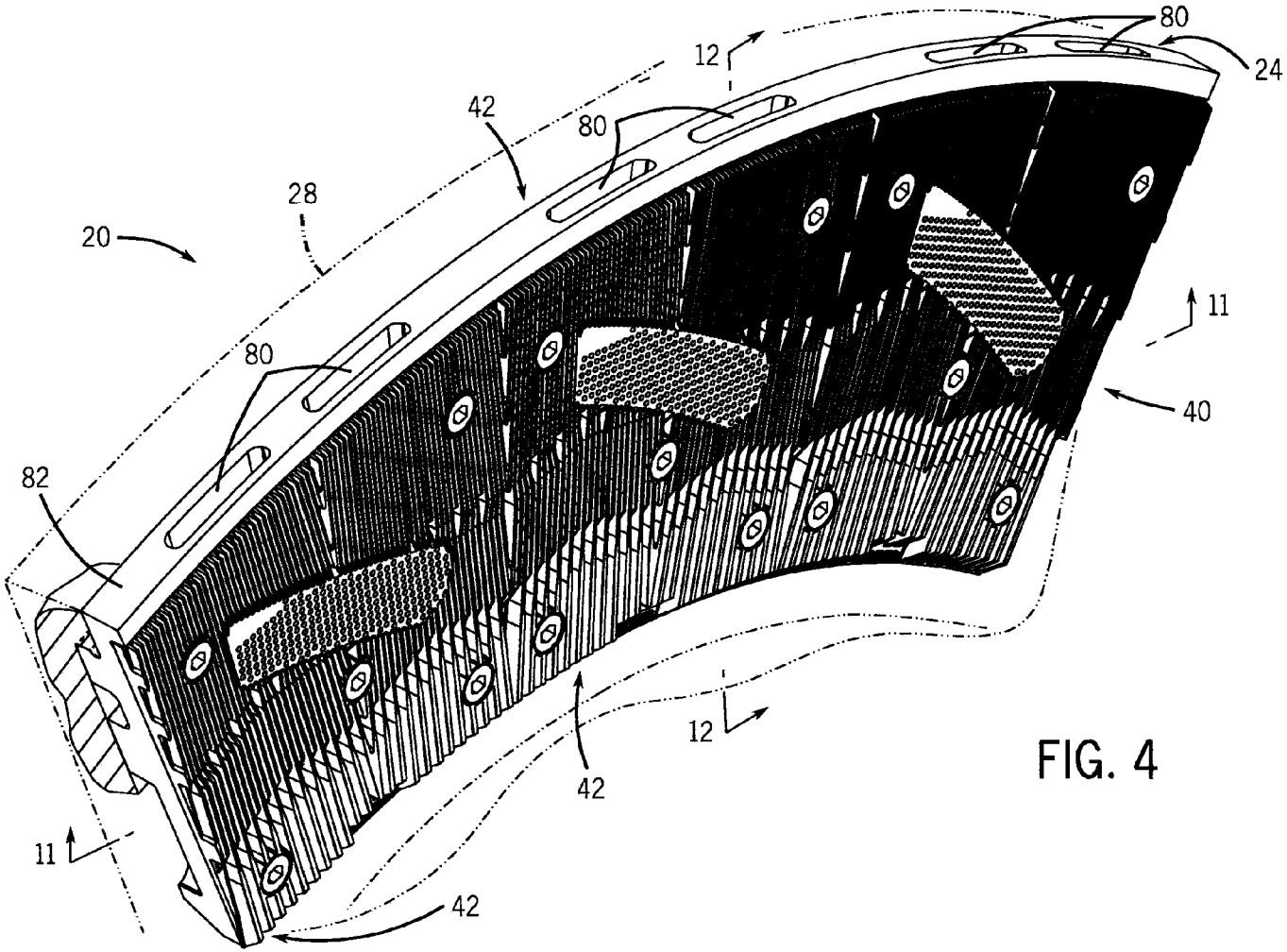
FIG. 4 is an isometric view showing an assembly of three refiner segments on an adapter subplate with the refiner disk cut-away and in dotted lines.
Figure 5:
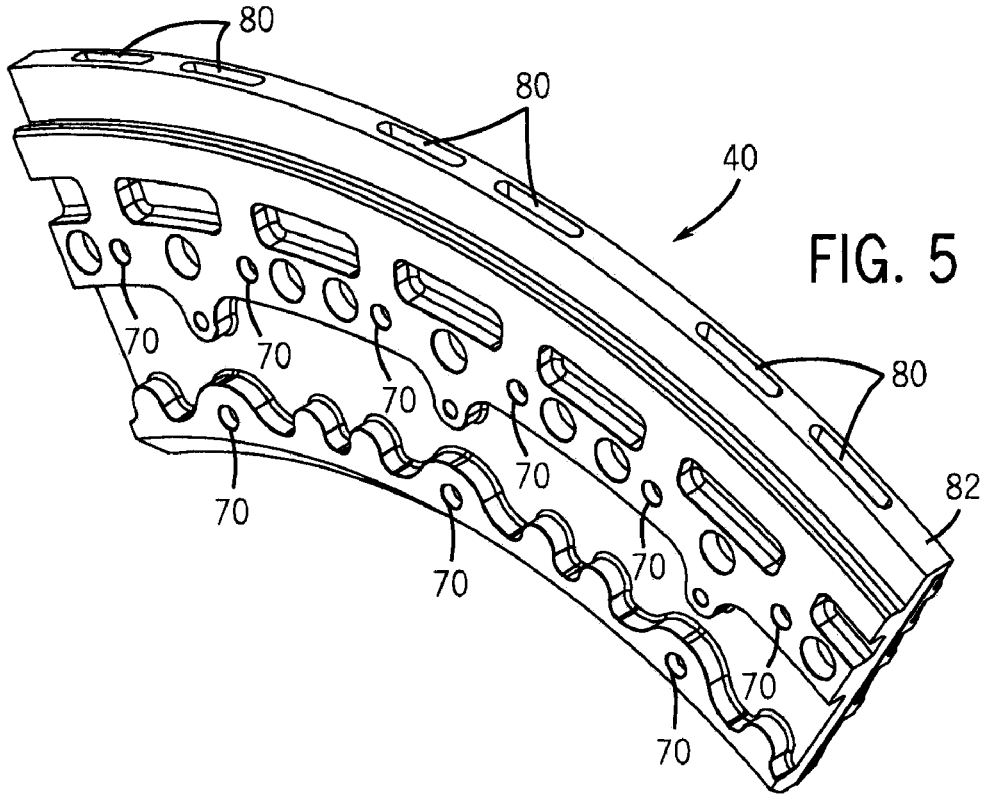
FIG. 5 is a rear isometric view of an adapter subplate.
Figure 6:
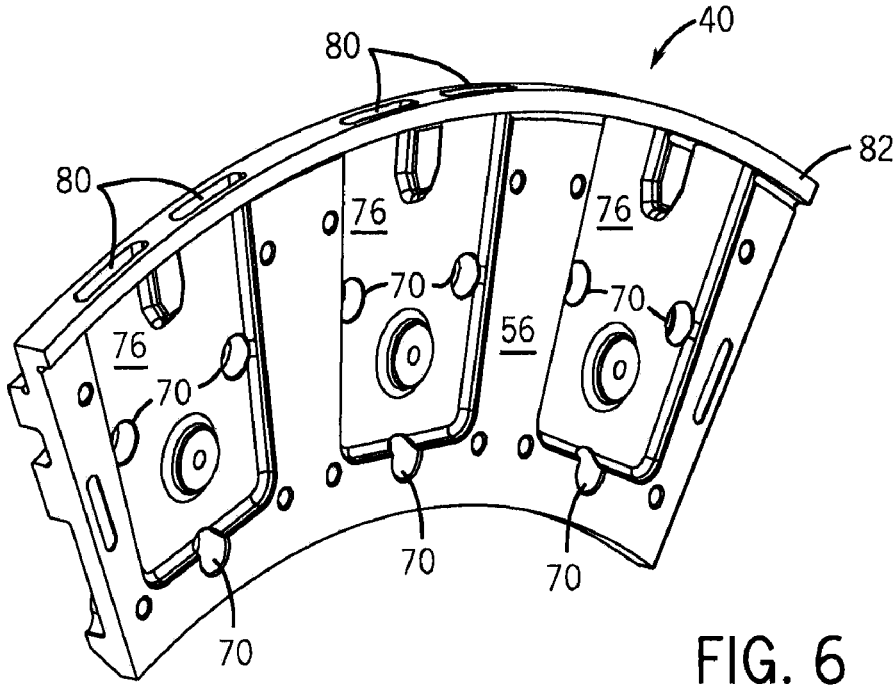
FIG. 6 is a front isometric view thereof.

With reference to the accompanying drawings, wherein like numbers refer to similar parts, a universal refiner plate assembly 20 shown in FIG. 4 embodying the present invention is equipped to be installed within various disk refiners such as a double disk refiner (not shown), a multiple disk refiner (not shown), or a counter-rotating disk refiner 22 as shown in FIG. 1. Although the present invention can be used with each rotating disk and/or non-rotating disk of a double disk or multiple disk refiner, for simplicity, it will be described only with respect to the rotating disks of the counter-rotating disk refiner 22 shown in FIG. 1.

The counter-rotating disk refiner 22 has a first refiner plate assembly 24 and a second refiner plate assembly 25 respectively mounted to two refiner plate mounting surfaces 26 and 27 of two counter-rotating disks 28 and 29. The two counter-rotating disks 28 and 29 are each mounted on a shaft 30 and 31, each of which is driven individually by motors (not shown). The disk refiner 22 has a feed funnel 32 for guiding slurry or in some situations wood chips to an opening 34 which transports the slurry to a refining zone 36 located between the first 24 and second 25 refiner plate assemblies. A housing 38 is provided with an accepts collection area to collect the refined slurry after the refined slurry flows out from the refining zone 36.

Figure 2:
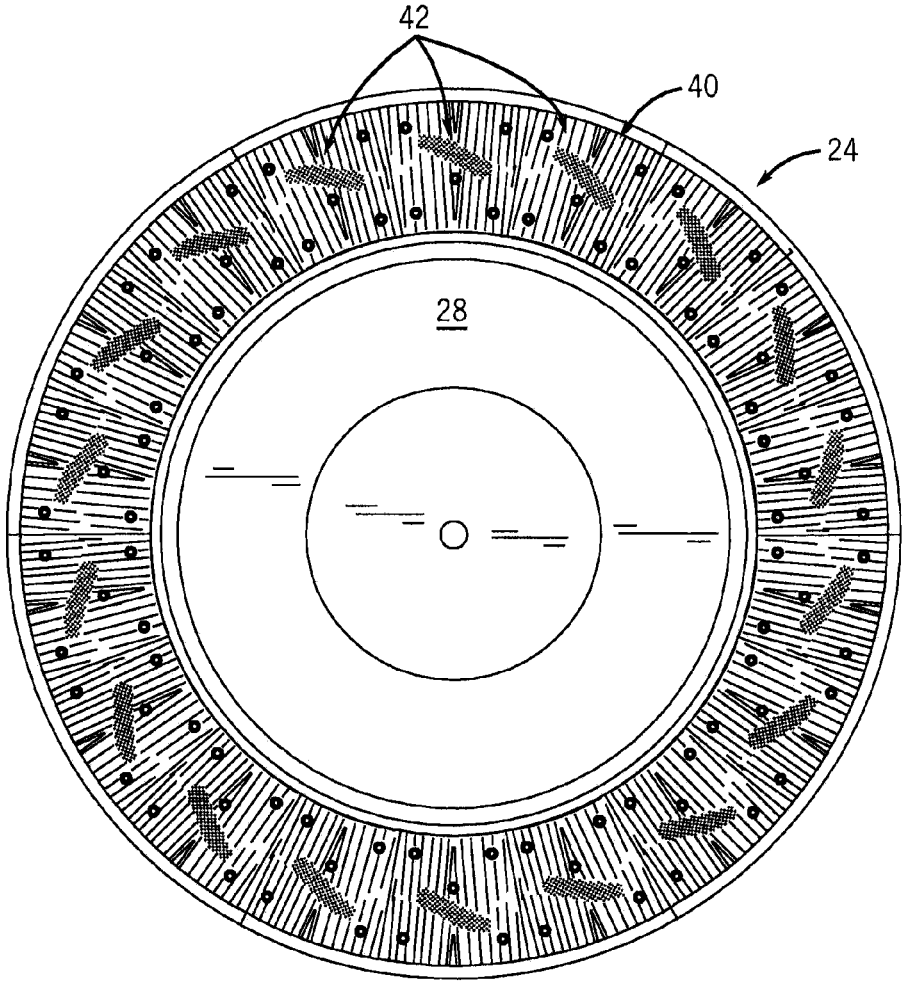
FIG. 2 is a front elevational view showing one disk of the disk refiner of FIG. 1 having the refiner plate assembly according to the present invention.
Figure 3:
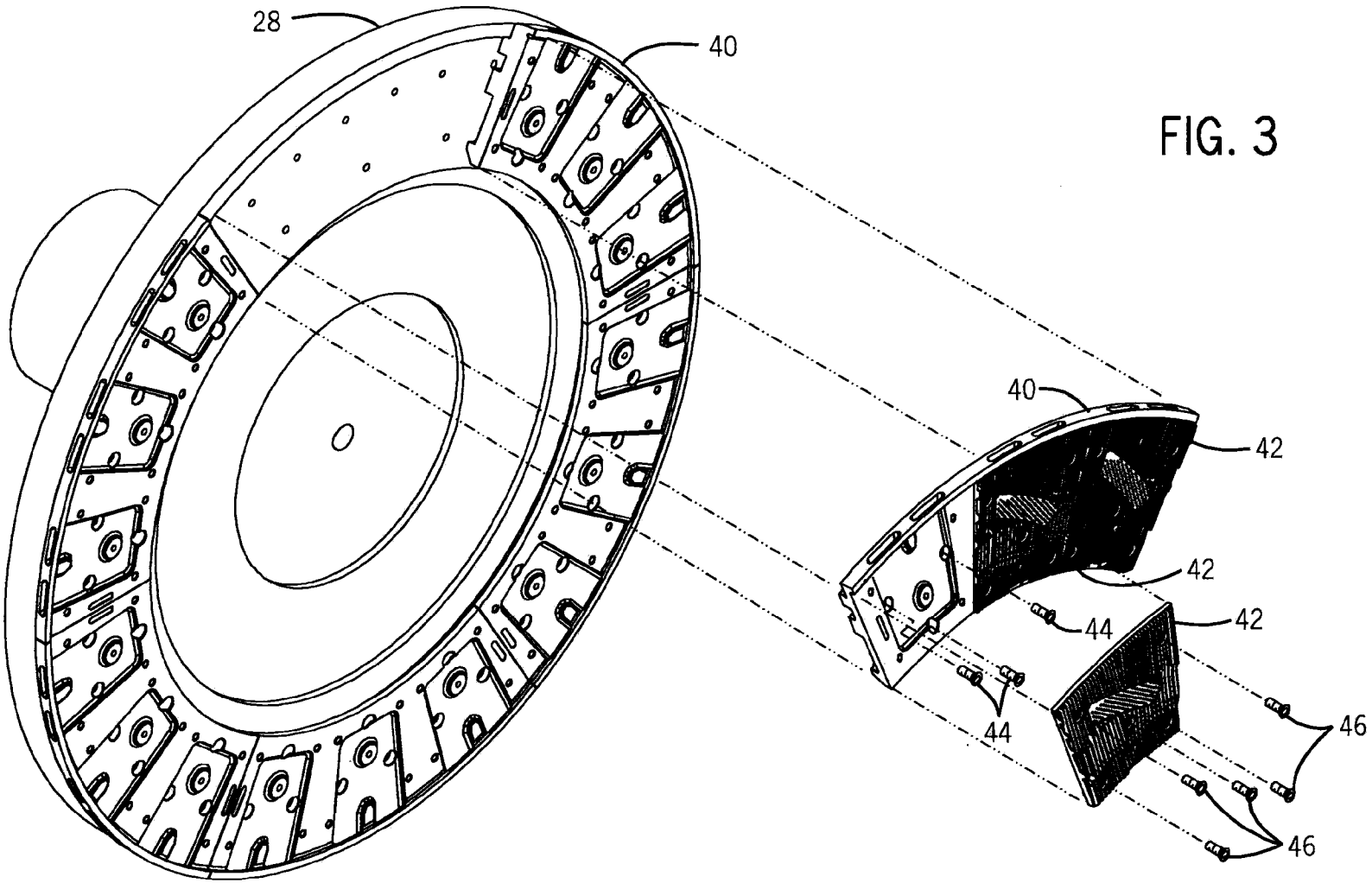
FIG. 3 is an assembly view showing one adapter subplate exploded from the disk and one of three refiner segments exploded from the adapter subplate.

The first 24 and second 25 refiner plate assemblies can be constructed in the same manner, and therefore, only the first refiner plate assembly 24 will be discussed in detail. The first refiner plate assembly 24 includes as primary components an adapter subplate 40 and a refiner segment 42 along with associated adapter subplate fasteners 44 and refiner segment fasteners 46. The adapter subplate fasteners 44 bolt the adapter subplate 40 to the disk 28 and the refiner segment fasteners 46 bolt the refiner segment to the adapter subplate 40. There can be a plurality of adapter subplates 40 arranged end to end into an annular ring, when the refiner mounting surface 26 is annular, as shown in FIGS. 2-3. Similarly, there can be a plurality of refiner segments 42 also arranged end to end into an annular ring as shown.

Figure 7:
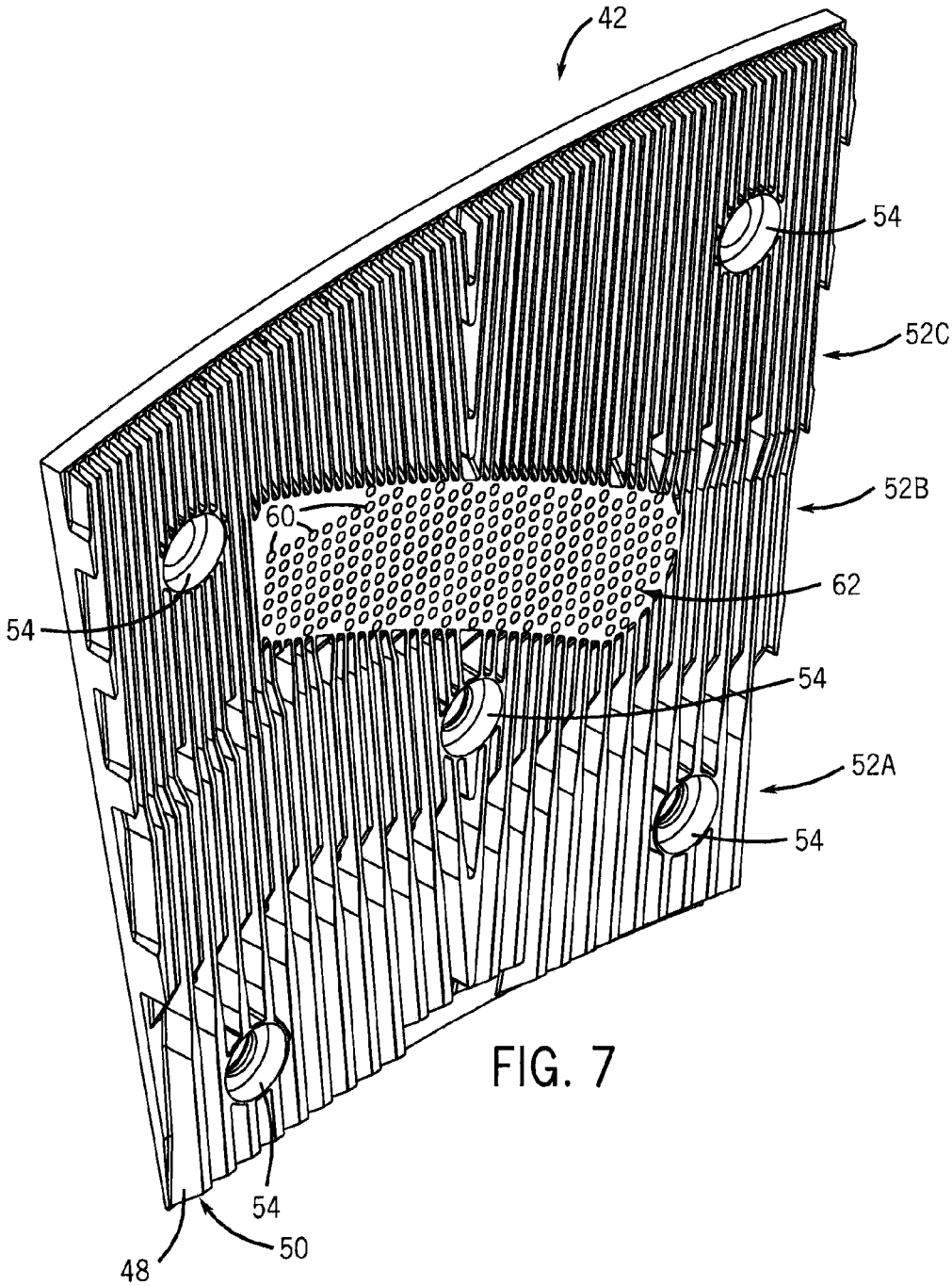
FIG. 7 is a front isometric view of a refiner segment.
Figure 8:
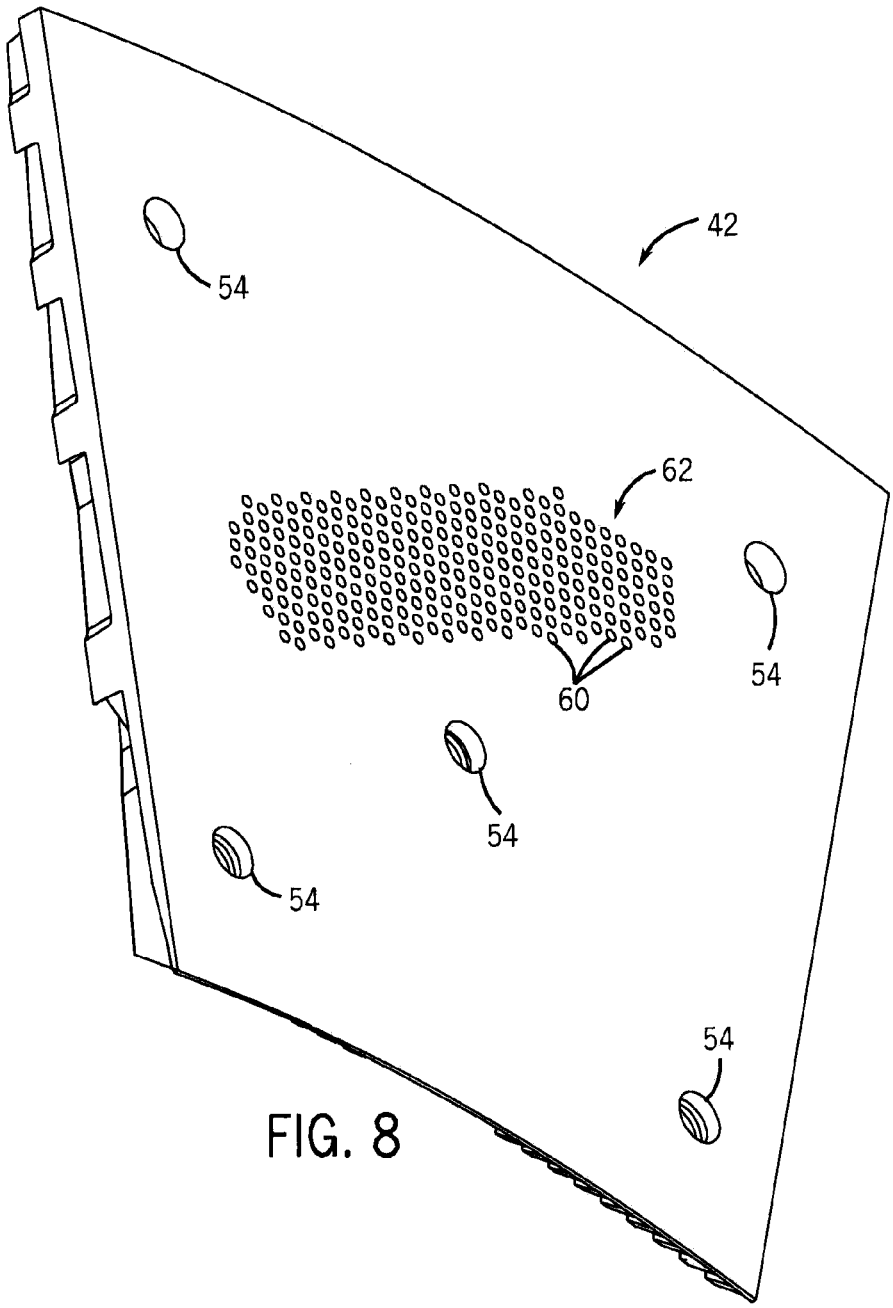
FIG. 8 is a rear elevational view thereof.

Referring to FIGS. 7-8, each refiner segment 42 has arrays of protruding refiner bars grouped in sets of straight parallel bars 48 and grooves 50 arranged in repeating fields, such as fields 52A-52C, which collectively define a refining surface 53. The bar and groove pattern shown is for illustrative purposes. Various arrays and patterns of protruding refiner bars are known in the art, however, typically the fields of bars become progressively finer, or narrower in width, in the direction from the inner periphery to the outer periphery of each refiner segment 42. Larger vanes or breaker bars (not shown) can be present radially inwardly of the refiner bars 48 to help break up and propel the pulp slurry radially outward and into the refiner bars 48 during the refining operation. In any event, it should be understood that any conventional pattern can be used on the segment. Also, different refiner segments 42 in the annular ring can have different bar patterns, however, typically each refiner segment 42 in the annular ring has essentially the same pattern.

Interspersed amongst the bars 48 are mounting holes 54, whereby the refiner segments 42 can be bolted or screwed to the segment mounting surface 56 of the associated adapter subplate 40, which has a corresponding bolt pattern, via refiner segment fasteners 46. Note that the five-hole bolt pattern shown in the figures is exemplary, and could be replaced with another pattern. However, in any case it can be a standardized pattern used by the refiner plate manufacture universally for various different disk refiners and diameters, regardless of disk refiner make. When the refiner bars 48 become worn or damaged from use, the associated refiner segment(s) 42 can be replaced simply by removing the refiner segment fasteners 46.

Also clustered amongst the refiner bars 48, in a flat area uninterrupted by the refiner bars 48, are a plurality of relatively small passages 60 defining one or more filter sections 62. A single one, some or all of the refiner segments can have a filter section 62. The passages 60 extend through the body of the refiner segment 42, for example in a generally axial direction perpendicular to the bars 48 at the refining surface 53. The passages 60 can have the same or different opening sizes or cross-sectional profiles, but in any event are sized to permit passage of pulp fibers from the slurry to that have been sufficiently refined, or for whatever reason are of an acceptable size, which are commonly referred to as "accepts". Typical sizing is 2 to 4 millimeters.

The filter section 62 is located at an intermediate location radially between the inner and outer peripheries of the refiner segment 42 so that the accepts, as well as steam generated by the pressurization of the liquid slurry, can be redirected away from later stages, or radially outer areas, of the refining zone. Removing the accepts and steam at this intermediate stage improves refining efficiency by subjecting a greater volume fraction or density of pulp fiber that needs refining to the later stages, or outer portions, of the refining zone, since this space is not otherwise occupied by steam or accepts. The filter section 62 is best located at the area of the highest volume fraction of fibers. The volume fraction of fibers is generally the highest at the area of lowest velocity and maximum pressure in the refining zone. This location can be obtained through empirical study of the refiner plate assembly in use. Specifically, temperature sensors can be embedded in an opposing refiner segment at different radii along the length of that refiner segment. Then, the temperature data can be used to determine the high pressure location. Empirical study for the refiner assembly of the present invention indicates that the high pressure area occurs within a range of radii approximately ½ to ⅔ of the radial length of the refiner segment, and thus, the filter section is located at approximately ½ to ⅔ of the radial length of the refiner segment. Conventional refiner segments are typically bolted to the refiner plates along an arc or line corresponding to the low velocity/high pressure to ensure the bolting forces securely mounting the refiner segments. Consequently, conventional refiner segments do not provide optimal results because either the bolt holes interfere, limit or prevent locating the filter section along the low velocity/high pressure area, which reduces the evacuation of accepts and steam from the intermediate location, thereby reducing refining efficiency, or the bolt holes are moved to another location away from the low velocity/high pressure center, which can adversely impact proper mounting of the refiner segments.

In addition to the location of the passages 60, the configuration and orientation of the filter section 62 can affect accepts evacuation throughput and thereby refining efficiency. In FIGS. 4, 7 and 8, the cluster of passages 60 that make up the filter section 62 takes a generally arcuate configuration such that a centerline drawn through the filter section 62 would have a varying radius. In the this particular configuration, the filter section 62 is located at or near the low velocity/high pressure center, and thus the location of highest volume fraction of fibers, and is tipped tangentially, that is skewed radially outward at the downstream end compared to the upstream end. Since the disk 28 shown in FIG. 4 would rotate counterclockwise, this configuration of the filter 62 generally follows the flow of pulp through the refining zone at this intermediate radial location, which it has been found through empirical study to improve accepts evacuation throughput, and thereby refining efficiency.

Figure 14:
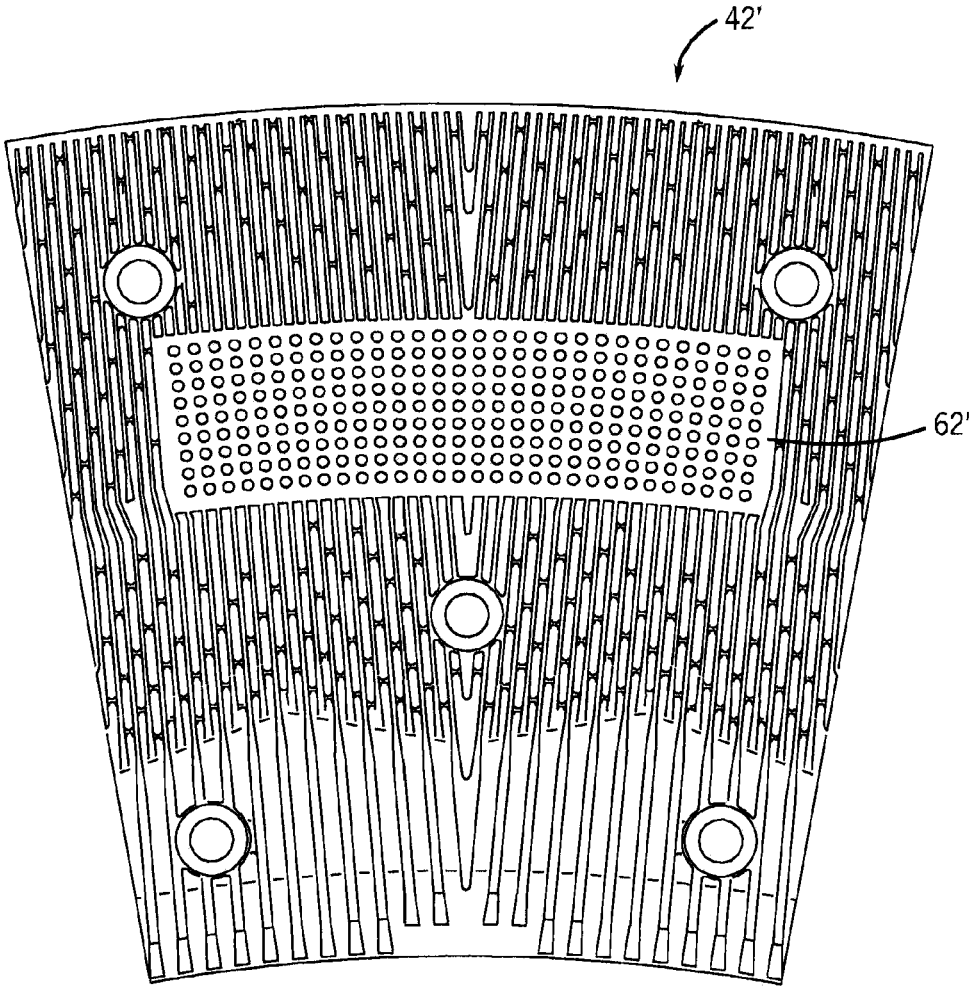
FIGS. 14-16 are front elevational views of exemplary refiner segments with alternate filter section configurations.
Figure 15:
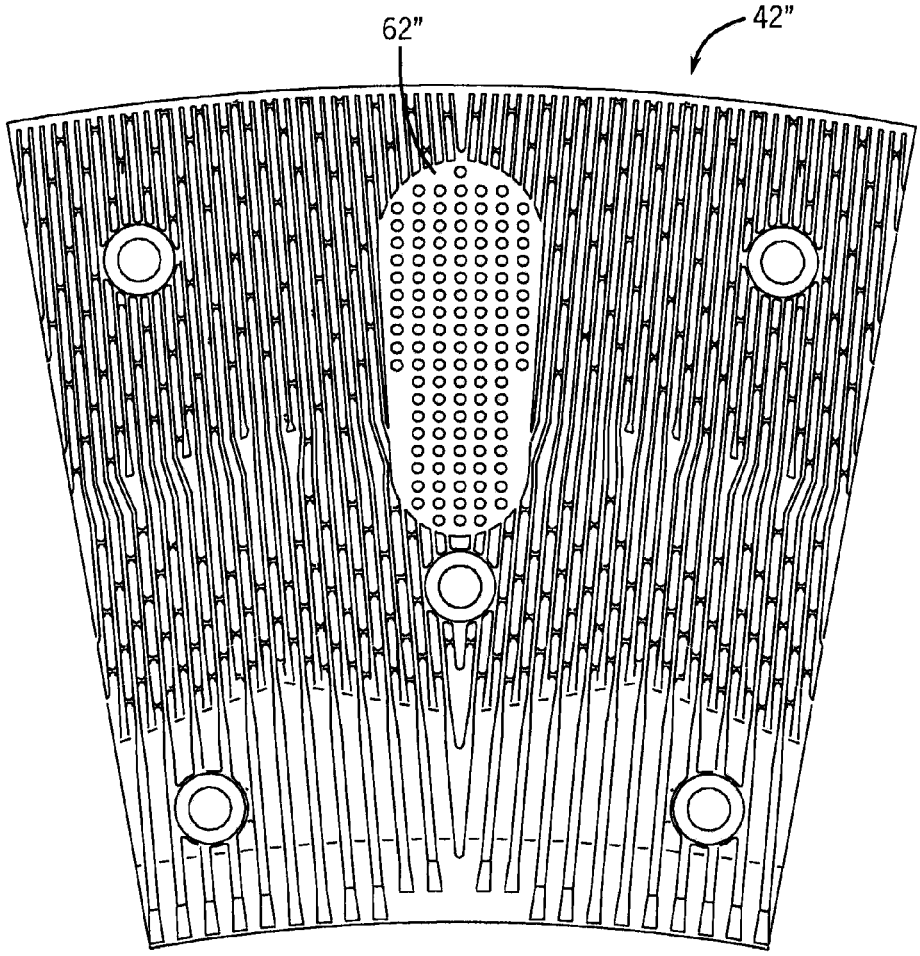
Figure 16:
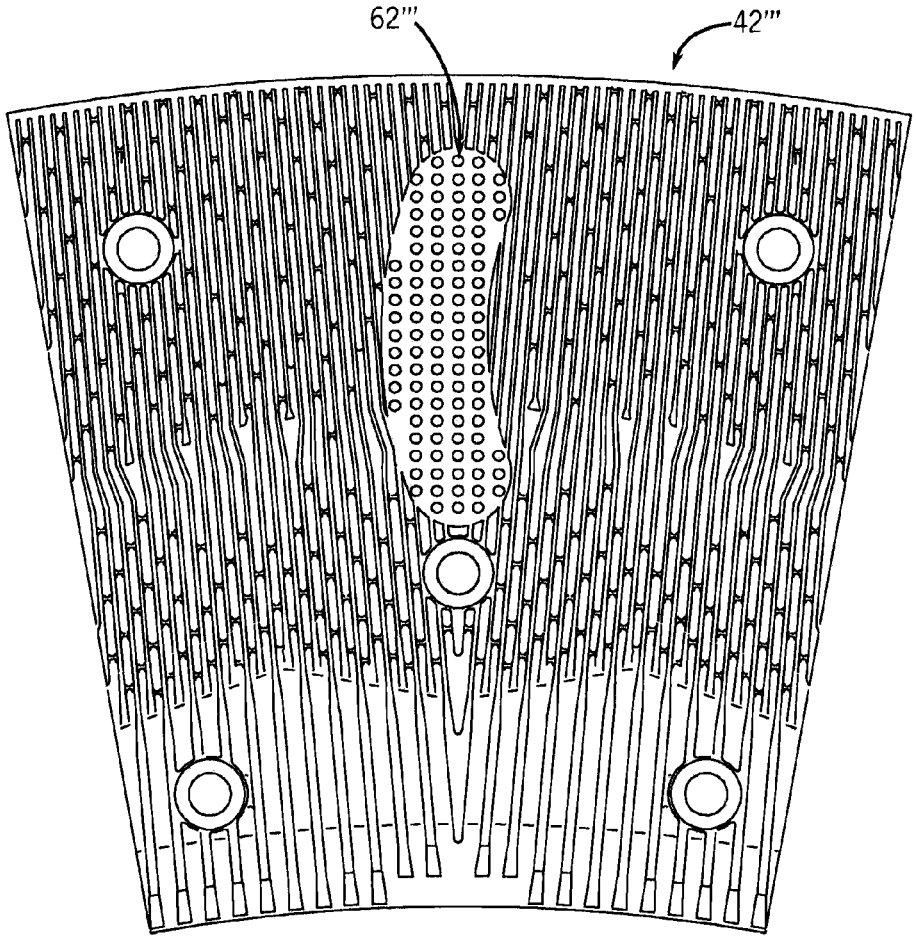

FIGS. 14-16 illustrate examples of alternate refiner segments which could be utilized with the present invention, including refiner segment 42' shown in FIG. 14 which has a filter section 62' with a centerline that follows a constant radius; refiner segment 42" shown in FIG. 15 which has an oblong filter section 62" that is aligned radially; refiner segment 42''' shown in FIG. 16 which has an arc-shape filter section 62''' that is radially oriented but follows a curved path, which can be in the direction of rotation of a clockwise rotating disk, for example.

Figure 9:
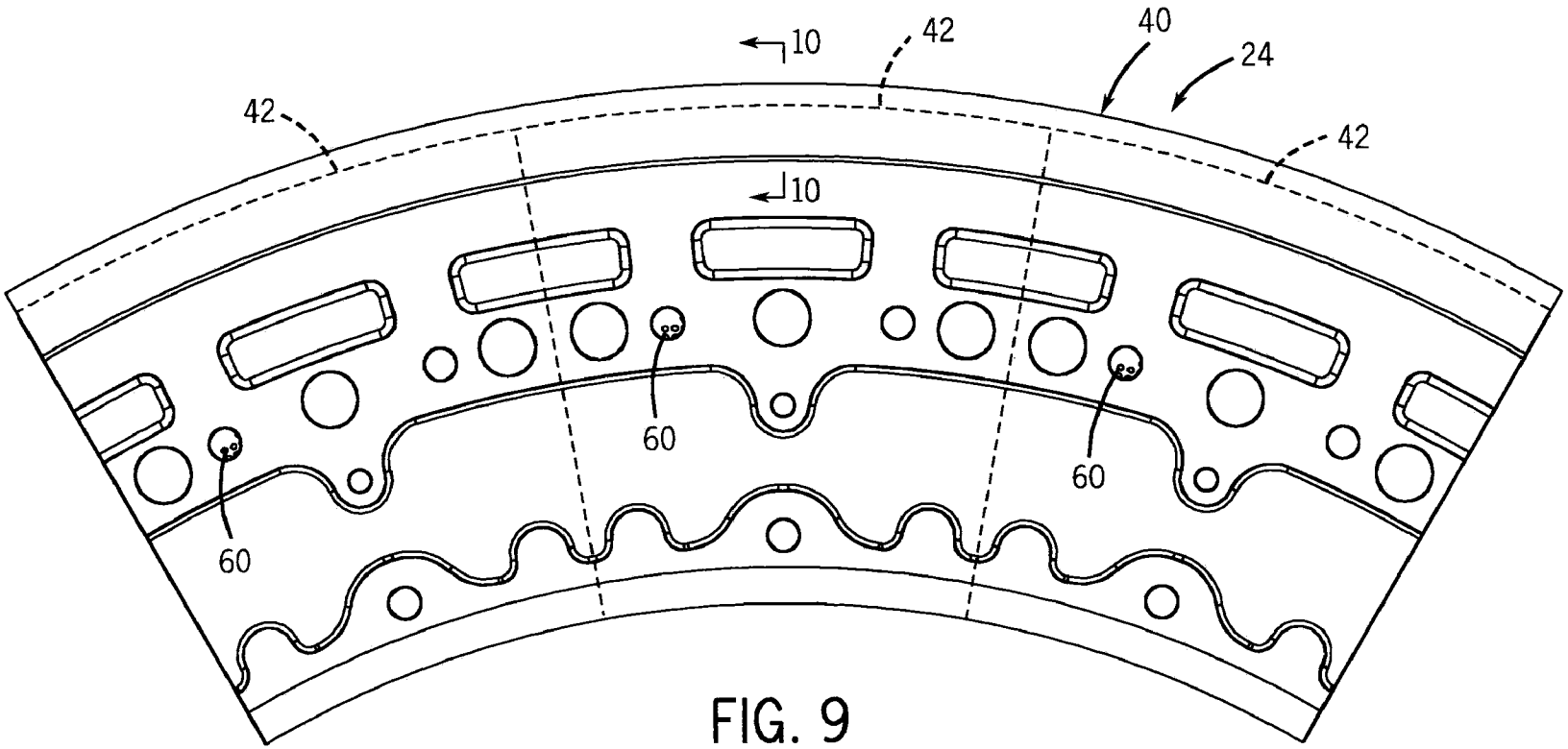
FIG. 9 is a rear elevational view of an adapter subplate with three refiner segments shown in dotted lines.
Figure 11:
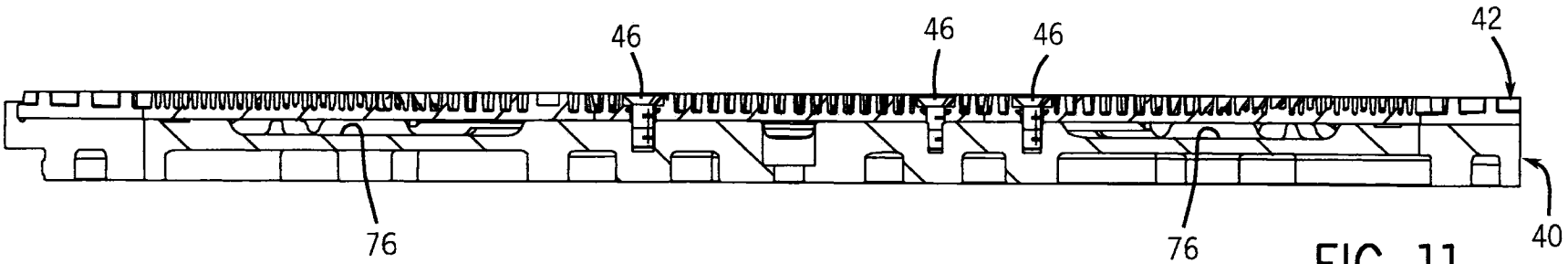
FIG. 11 is a sectional view of the adapter subplate and refiner assembly taken along line 11-11 of FIG. 4.

Referring to FIGS. 3-6 and 9, as mentioned, the adapter subplate 40 can be a single annular piece, or preferably is made up of a plurality of individual adapter subplates 40 that when fitted together form a complete annular ring. The adapter subplates 40 and refiner segments 42 can be any suitable arc width (i.e., circumferential dimension), and in particular, each adapter subplate 40 can be sized to hold multiple refiner segments 42, such as three refiner segments 42 as shown in FIGS. 4 and 9, which has better hoop stress characteristics than a smaller adapter subplate. The segment mounting surface 56 of each adapter subplate 40 has mounting holes 70 whereby the adapter subplate 60 can be bolted or screwed via the adapter subplate fasteners 44 to the rotating disk 28. The number, location, size and spacing of the mounting holes 70 are selected to match the mounting holes in the disk 28 (not shown), which are typically unique to individual disk refiner manufacturers. However, as mentioned above, the adapter subplates 42, which are not typically a wear part that need replacement, allow universal refiner segments that are interchangeable with different refiners of the same diameter.

Figure 10:
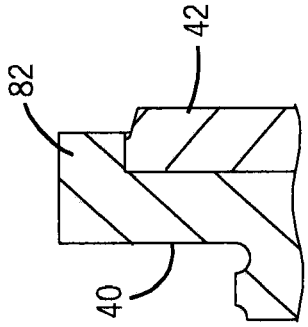
FIG. 10 is a partial sectional view of the adapter subplate and refiner segment assembly taken along line 10-10 of FIG. 9.
Figure 12:
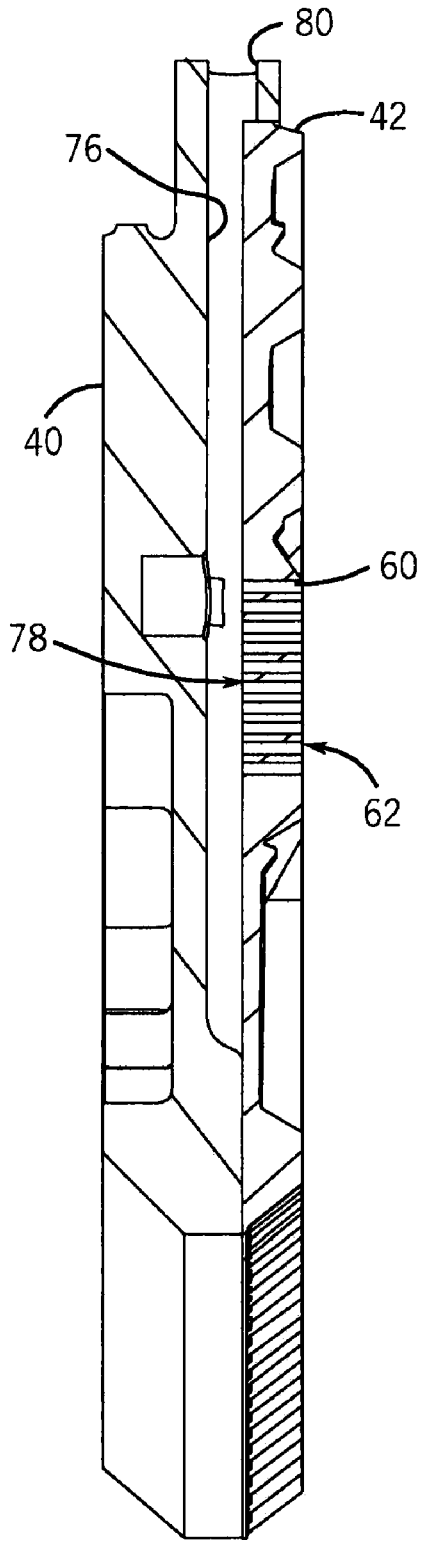
FIG. 12 is a sectional view of the adapter subplate and refiner assembly taken along line 12-12 of FIG. 4.

The adapter subplates 40 also have a recess 76 formed in the segment mounting surface 56 that defines an evacuation channel that communicates with the passages 60 of the filter section 62 in the refiner segment 42. The evacuation channel and the passages 60 effectively combine to create the overall evacuation passage 78 that spans two discrete components for the steam and accepts to exit from the intermediate radial location. One, some or all of the adapter subplates 40 can be formed with such evacuation channels, and in the case of adapter subplates 40 that hold multiple refiner segments 42, as shown in FIG. 4, the segment mounting surface 56 can define multiple recesses 76 that are isolated from one another or are interconnected via radial passages (not shown). Each of the recesses 76 communicate with one or more radially extending outlet openings 80 formed in an outer rim 82 of the adapter subplate 40. The accepts (and steam) exit through the outlet openings 80 and are passed through to the accept collection area of the disk refiner housing along with the accepts that come directly from the refining zone between the disks 28 and 29. The outer rim 82 projects radially outward of the outer end of the refiner segments 42 and extends in the axial direction between the underside and refining surface of the refiner segments 42. The refiner segments 42 can engage the rim 82 and be further secured against radially outward movement, as shown in FIG. 10.

Thus, since the adapter subplate 40 defines the radially extending recesses 76, and thus the majority of the evacuation passage 78 rather than the refiner segments 42, the refiner segments are much thinner and lighter than conventional refiner segments with an evacuation channel cast in its interior. Moreover, creating smaller refiner segments, and in particular refiner segments without an integral hollow core, enables refiner plate manufacturers to utilize a different casting process. Investment casting is not feasible to make the conventional large refiner plate segments because of the high cost in utilizing this process. Making smaller refiner plates will make it economically feasible to use investment casting. Investment casting small refiner plate segments is on par economically with casting large refiner segments using the conventional sand casting method. Drawbacks to the sand casting method include the potential for the segments to warp, not completely filling the area reserved for the refiner bars, and the difficulty associated with getting the volume of metal to fill the cast evenly and at the same time. Also, imperfections can result from sand casting as a result of gas contamination of the molten steel from the sand that is burned off during casting. Moreover, investment casting is a much more precise method of casting metal pieces than the sand casting method. As a result, the refiner plate segments of the invention have more uniform refiner bar widths, groove widths, and groove depths. Further, thinner refiner segments 42 allow for more cost effective and accurate milling operations, such as laser and water jet cutting techniques, to be used on the refiner segments, such as to define the periphery of a refiner segment.

Due to the corrosive environment of a paper refiner, the adapter subplates 40 and the refiner segments 42 are made out of a strong, corrosion-resistant material, such as stainless steel. The adapter subplates 40 are custom made to match the mounting pattern of each different disk refiner manufacturer for a given refiner diameter. The refiner segments 42 can now be universalized and mass produced and assembled in any disk refiner of a given diameter. This represents a universal retrofit of refiner segments 42 of the same refiner bar pattern for all the same diameter refiners of any type, including double disk, multiple disk, or counter-rotating disk refiners regardless of manufacturer.

With reference to FIGS. 1 and 11-13, in operation, pulp slurry is fed into the disk refiner 22 through feed funnel 32 and into the center, or radially inner part, of the refining zone 36 between the disks 28 and 29. Pressure within the disk refiner 22 and forces from the counter-rotating disks 28 and 29 drive the pulp radially outer through the refining zone 36. The pulp fibers come into contact with the bars 48 of the refining surfaces of the refiner segments 42. The larger bars at the radially inner part of the refiner surfaces begin to break down and refine coarse fibers. The bulk of partially refined coarse fibers continue through the refining zone 36 and are further broken down by the progressively smaller bars of the refining surfaces until the fibers pass through the outer periphery of the refiner segments 42 and the accepts are collected in an accept area within the housing 38. However, not all fibers entering the refining zone 36 are the same size. Some fibers are small enough upon entering the refining zone 36, while other fibers need only the initial stage of refinement to become acceptably small. Those accepts that pass along the intermediate location of the filter section 62 can thus be redirected through the passages 60 axially outwardly into the recesses 76 in the adapter subplates 40 and radially through the recesses 76 to be expelled through the radial outlet openings 80 for collection in the accepts area of the housing 38. Furthermore, steam within the refining zone 36 created by pressurization of the pulp slurry is also evacuated with the accepts fibers through the passages 60, recesses 76 and outlet openings 80. Accepts and steam are thus carried away from the intermediate location of the refining zone 36 through the evacuation passage 78 so that the volume adjacent the refining surfaces of the refiner segments 42 are not occupied by steam and already refined fibers. Refining efficiency of the disk refiner is thus improved, on the order of a 50% improvement when compared to conventional systems in which the refined fibers and steam are not evacuated from the intermediate location of the refining zone. Importantly, this improved efficiency is provided in an assembly of adapter subplates 40 and refiner segments 42, with the aforementioned benefits with regard to the smaller, more universal refiner segments. Thus, the evacuation passage 78 is formed by a combination of components such that the evacuated steam and fibers passes across an interface between the refiner segment 42 and adapter subplate 40 components.

It should be appreciated that merely certain embodiments of the invention have been described above. However, many modifications and variations to the described embodiments will be apparent to those skilled in the art, which will be within the spirit and scope of the invention.

Figure 13:
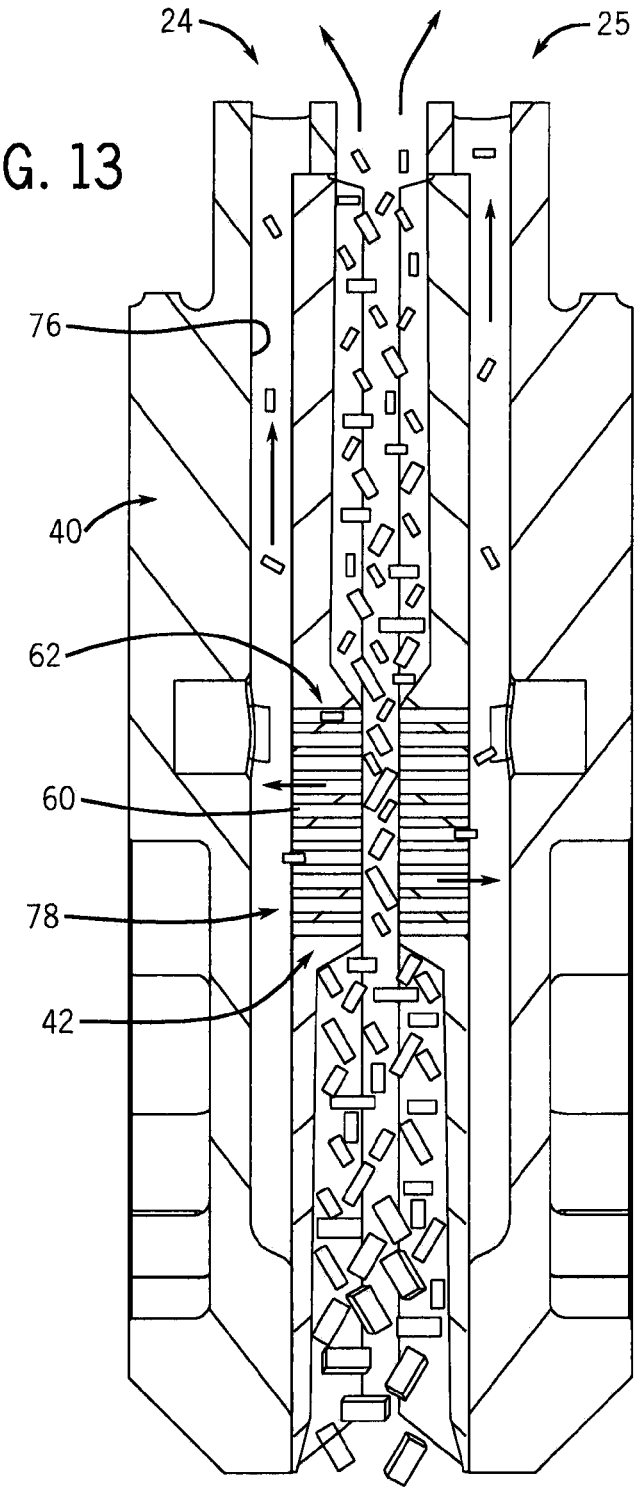
FIG. 13 is a sectional view of opposing refiner plate assemblies showing the flow of pulp fibers through the refining zone and the evacuation passages through the associated refiner segments and adapter subplates.

For example, while the present invention has been described herein in connection with a counter-rotating disk refiner, it should be understood that the adapter subplate and refiner segment assembly could be utilized in double disk and multiple disk refiners. The adapter subplate and refiner segment assembly could be mounted to one or all of the rotating rotors and stationary stators in double disk or multiple disk refiners. Additionally, in the above-described counter-rotating disk refiner, the same adapter subplate and refiner plate assembly as described above with respect to disk 28 could be utilized on disk 29, as shown in FIG. 13. Or, disk 29 could have a different refiner plate assembly, with or without adapter subplates and refiner segments or with refiner segments having different bar patterns, or with or without evacuation features. Still further, the above-described embodiment utilizes threaded fasteners that extend through the face of the refiner segments to mount the refiner segments to the adapter subplates and thereby the refiner disk. However, another mechanical attachment mechanism could be employed in which no fastener passes through the face of the refiner segments. For example, a clamping arrangement as disclosed in U.S. Pat. No. 5,934,585 could be used. As mentioned above, the disclosure of this patent, particularly the description and associated figures noted at col. 5, line 36 to col. 7, line 26, is hereby incorporated by reference herein. With this boltless mounting technique not only thinner refiner segments can be used, but also smaller arc segments (i.e., having a lesser circumferential direction) can be used with finer bars of a single field (or bar size). This further makes the refiner segments easier and less costly to manufacture, while improving the precision of the refiner segments. The finer bars of the refiner segments also provide a refining surface better suited for low-intensity refining applications, which can increase the strength characteristics of certain fibers and reduce the specific energy required during refining.

Therefore, the invention should not be limited to the described embodiments. To ascertain the full scope of the invention, the following claims should be referenced.

What is claimed is:

1. A refiner plate assembly for refining pulp in a disk refiner having a refiner plate mounting surface, said refiner plate assembly comprising:

an adapter subplate defining a segment mounting surface and an evacuation channel leading from an intermediate location of the refiner plate assembly to an outer periphery of the adapter subplate; and a refiner segment having a refining surface and an underside opposite the refining surface, the refiner segment including a filter section defined by a plurality of passages extending between the refining surface and the undersurface, the plurality of passages being sized to permit steam and accept pulp fibers at the intermediate location of the refiner plate assembly to pass from the refining surface to the evacuation channel of the adapter subplate;

wherein the adapter subplate is mountable to the refiner plate mounting surface of the disk refiner and the refiner segment is releasably mountable to the segment mounting surface of the adapter subplate such that the refining surface of the refiner segment is at a refining zone of the disk refiner.

2. The assembly of claim 1, wherein the evacuation channel includes an open recess in the segment mounting surface proximate the filter passages.

3. The assembly of claim 2, wherein the adapter subplate includes an outer rim defining a radially extending opening forming part of the evacuation channel in communication with the recess in the segment mounting surface.

4. The assembly of claim 3, wherein the outer rim of the adapter subplate extends radially beyond an outer periphery of the refiner segment and extends axially between the underside and the refining surface of the refiner segment.

5. The assembly of claim 4, wherein the outer rim of the subplate engages the outer periphery of the refiner segment when the refiner segment is mounted to the segment mounting surface of the adapter subplate.

6. The assembly of claim 4, wherein the radially extending opening of the outer rim is located to an axial side of the underside of the refiner segment opposite the refining surface of the refiner segment.

7. The assembly of claim 1, wherein the adapter subplate is mounted to the refiner plate mounting surface by a plurality of fasteners.

8. The assembly of claim 1, wherein the refiner segment is releasably mounted to the segment mounting surface by a plurality of fasteners.

9. The assembly of claim 8, wherein at least one fastener extends through the evacuation channel radially inward of the filter section.

10. The assembly of claim 1, wherein the refining surface of the refiner segment is defined by axially extending bars spaced apart by grooves.

11. The assembly of claim 10, wherein the filter section is uninterrupted by the bars and grooves.

12. The assembly of claim 1, wherein the filter section has a centerline that varies in radial position as it extends in the circumferential direction.

13. The assembly of claim 1, wherein the filter section is located at the intermediate location where a volume fraction of pulp fibers is the highest.

14. The assembly of claim 1, including a plurality of refiner segments.

15. A refiner plate assembly comprising:

at least two substantially flat annular refiner plate mounting surfaces defined by opposing disks of a disk refiner defining a refining zone therebetween;

a plurality of adapter subplates mounted to each refiner plate mounting surface end to end in an annular arrangement, at least one of the annular adapter plate arrangements having a segment mounting surface defining an evacuation channel extending from an intermediate location radially between inner and outer peripheries of the at least one annular adapter subplate arrangement to an opening in an outer rim of the at least one annular adapter subplate arrangement;

a plurality of refiner segments mounted to each segment mounting surface end to end in an annular arrangement, each refiner segment having an axial refining surface with a plurality of refining bars located in the refining zone of the disk refiner;

wherein at least one annular refiner disk arrangement is associated with the at least one annular adapter subplate arrangement and includes a filter section that is uninterrupted by the bars and includes a plurality of passages extending between the refining surface and an undersurface thereof, the plurality of passages being sized to permit steam and accept pulp fibers at the intermediate location to pass from the refining surface to the evacuation channel of the at least one annular adapter subplate arrangement.

16. The assembly of claim 15, further including:

a plurality of adapter subplate fasteners removably mounting the adapter subplates to the refiner plate mounting surfaces; and a plurality of refiner segment fasteners removably mounting the refiner segments to the segment mounting surfaces.

17. The assembly of claim 15, wherein each adapter subplate mounts multiple of the refiner segments.

18. The assembly of claim 15, wherein the filter section is located at the intermediate location where a volume fraction of pulp fibers is the highest.

19. A method of refining pulp in a disk refiner having a refiner plate assembly according to claim 1, comprising:

passing pulp into the refining zone;

rotating the refiner plate assembly;

passing pulp along the refining surface of the refiner segment from an inner periphery;

passing steam and accept pulp fiber through the filter section at the intermediate location of the refiner segment; and passing the accept pulp fiber from the filter passages to the evacuation channel formed in the adapter subplate.

20. The method of claim 19, further comprising passing the accept pulp fiber within the evacuation channel radially through the adapter subplate and exiting through an opening in the adapter subplate.

* * * * *